US006695576B2

(12) United States Patent
Rosso et al.

(10) Patent No.: US 6,695,576 B2
(45) Date of Patent: Feb. 24, 2004

(54) PUMP FOR LIQUIDS, IN PARTICULAR, A CENTRIFUGAL PUMP FOR ELECTRIC HOUSEHOLD APPLIANCES

(75) Inventors: Sergio Rosso, Poirino (IT); Giorgio Morra, Asti (IT)

(73) Assignee: Plaset S.p.A., Turin (IT)

( * ) Notice: Subject to any disclaimer, the term of this patent is extended or adjusted under 35 U.S.C. 154(b) by 0 days.

(21) Appl. No.: 10/176,105

(22) Filed: Jun. 20, 2002

(65) Prior Publication Data

US 2003/0012640 A1 Jan. 16, 2003

(30) Foreign Application Priority Data

Jun. 20, 2001 (IT) ..... TO2001A0597

(51) Int. Cl.[7] ..... F04D 29/12

(52) U.S. Cl. ..... 415/113; 417/423.11

(58) Field of Search ..... 415/230, 231, 415/111, 113; 417/423.11, 423.12, 423.13

(56) References Cited

U.S. PATENT DOCUMENTS 3,850,550 A * 11/1974 Kaessen ..... 417/372

* cited by examiner

*Primary Examiner*—Edward K. Look
*Assistant Examiner*—Kimya N McCoy
(74) *Attorney, Agent, or Firm*—Howrey Simon Arnold & White LLP

(57) ABSTRACT

A pump is disclosed that comprises: (1) a support structure including a body having an annular end in which an opening is defined, and a volute connected to the said end of the body so as to define a pumping chamber therewith; (2) a bladed rotor disposed in the chamber and connected to a shaft which is mounted rotatably in the body and extends through the opening; and (3) a first and a second annular sealing member which are carried by the structure and which encircle the shaft in a leaktight manner. A lubrication chamber containing a lubricating grease is defined between the sealing members and the shaft. A first sealing ring, closer to the rotor, has an inner portion which forms at least one sealing lip which bears on the shaft, and a circular portion disposed outside the lip and having a substantially U-shaped cross-section with its convex side facing the rotor.

4 Claims, 2 Drawing Sheets

PUMP FOR LIQUIDS, IN PARTICULAR, A CENTRIFUGAL PUMP FOR ELECTRIC HOUSEHOLD APPLIANCES

PRIORITY CLAIM

This application claims the benefit of Italian National Patent Application Serial No. TO2001A000597 filed on Jun. 20, 2001, naming the same inventors as identified herein, which is hereby incorporated by reference in its entirety.

BACKGROUND OF THE INVENTION

The present invention relates to a pump for liquids and, in particular, to a centrifugal pump for electric household appliances and the like, for example, of the type to be operated by an alternating-current electric motor such as, in particular, a synchronous electric motor having a rotor with permanent magnets.

SUMMARY OF THE INVENTION

An object of the present invention is to propose an improved pump in which the hydraulic isolation between the rotor chamber and the environment in which its electric drive motor is disposed is ensured for as long as possible.

A further object of the invention is to propose a pump for liquids which is highly reliable and very quiet in operation.

This and other objects are achieved, according to the invention, by a pump for liquids comprising:

- a rigid support structure including a body having an annular end in which an opening is defined, and a volute connected to the said end of the body so as to define a pumping chamber therewith,
- a bladed rotor disposed in the chamber and connected to a drive shaft which is mounted rotatably in the body and extends through the opening, a first annular sealing member and a second annular sealing member which are carried by the structure and encircle the drive shaft in a leaktight manner in respective axially spaced-apart positions,
- a lubrication chamber containing a lubricating grease being defined between the sealing members and the drive shaft, and
- a first sealing ring, closer to the rotor, having a radially inner portion which forms at least one sealing lip which bears on the shaft, and a radially intermediate circular portion which is disposed outside the at least one lip and has a substantially U-shaped cross-section with its convex side facing the rotor.

By virtue of these characteristics of the first annular sealing member, the volume of the lubrication chamber is advantageously maximized and the quantity of grease which can be provided therein in correspondingly maximized. This ensures effective lubrication and optimal hydraulic isolation of the pumping chamber, in particular against any possible escapes of liquid by leakage along the rotor drive shaft.

According to a further characteristic, a shaped disc is disposed between the rotor and the first sealing ring and has a central opening through which the drive shaft extends with radial clearance; on the side facing the rotor, this disc has at least one annular projection which at least partially axially penetrates a corresponding annular element of the rotor in order to define a labyrinthine radial path therewith. The convex side of the radially intermediate circular portion of the first sealing ring, thus, advantageously extends in the immediate vicinity of (or even in contact with) the portion of the shaped disc which surrounds the drive shaft.

By virtue of this characteristic, the annular volume defined around the drive shaft between the first sealing ring and the shaped disc is thus minimized. The creation of any turbulence phenomena or vortices in this space is correspondingly reduced, with beneficial effects on the smoothness of rotation of the rotor and on the reduction of operating noise.

BRIEF DESCRIPTION OF THE DRAWINGS

Further characteristics and advantages of the invention will become clear from the following detailed description, given purely by way of non-limiting example with reference to the appended drawings, in which.

DESCRIPTION OF ILLUSTRATIVE EMBODIMENTS

Figure 1:
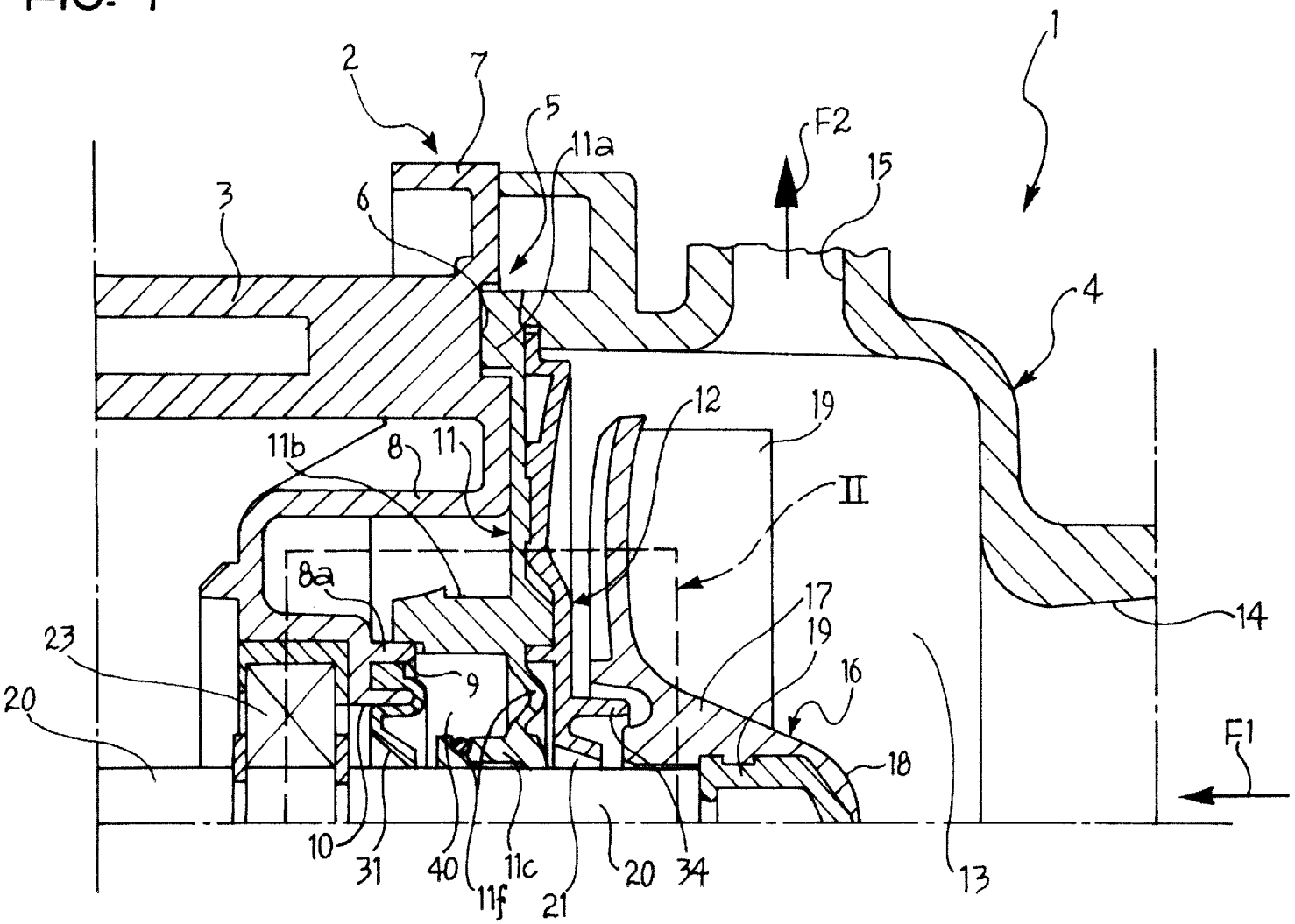
FIG. 1 is a partial view showing a pump for liquids according to the present invention, in axial section.

In FIG. 1, a pump for liquids, in particular a centrifugal pump formed in accordance with the present invention, is generally indicated 1. The pump is intended, for example, for use in electric household appliances such as washing machines or dishwashers.

The pump 1 comprises a rigid support structure 2 which, in the embodiment shown by way of example, comprises a body 3 made, for example, of aluminum, aluminum alloy or plastics material, to which the periphery of a volute 4 made, for example, of plastics material is connected in a leaktight manner.

The end of the body 3 which is connected to the volute 4 has an annular frame 5 in the front face of which a circular groove 6 is formed. Around this groove, the body 3 forms an outer radial flange 7.

Radially inside the face groove 6, the body 3 forms a shaped annular wall B with a sinuous, substantially S-shaped cross-section. The radially innermost portion of this wall 8, which is indicated 8*a*, has a circular face groove 9 facing towards the volute 4. Moreover, a central axial opening or duct 10 is defined inside this end portion 8*a* of the wall 8.

An enlarged rim 11*a* of a shaped annular sealing element 11 and the periphery of a shaped disc 12 of plastics material, are clamped between the volute 4 and the portion 5 of the body 3.

A flow of liquid to be pumped reaches a pumping chamber 13 defined between the volute 4 and the disc 12 through an inlet opening 14 of the volute, as indicated by the arrow F1 of FIG. 1, in operation. The volute 4 also has at least one peripheral output opening 15 for the discharge of the flow of pumped liquid in the direction indicated by the arrow F2.

In the pumping chamber 13, there is a bladed rotor, generally indicated 16. The rotor 16 is made, for example, of molded plastics material and, in the embodiment shown by way of example, comprises a bell-shaped body 17 from which a plurality of blades, indicated 19, which are integral with the body 17, extend.

In particular, the rotor 16 has a hub 18 in which a substantially cup-shaped insert 19, for example made of metal, is incorporated. The insert has, for example, an internal thread for the fixing of the rotor 16 onto the end of a drive shaft 20. The rotor 16 may, however, be coupled with the shaft 20 by other per se known methods.

The shaft 20 extends with radial clearance through a central opening 21 of the shaped disc 12 and through the opening 10 in the shaped wall 8 of the support body 3. In particular, the shaft 20 is mounted rotatably in a rotation bearing 23 carried by the body 3.

Figure 2:
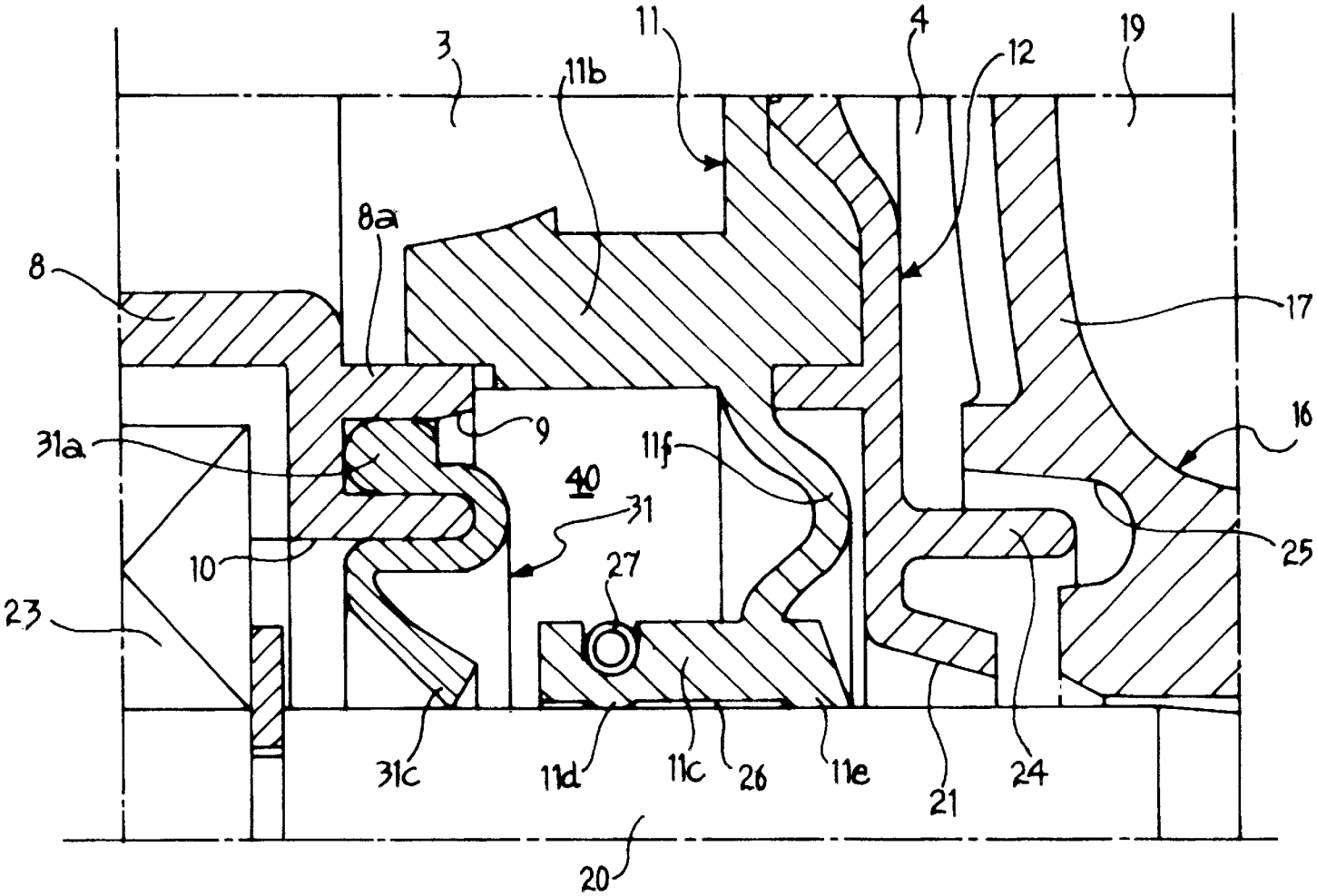
FIG. 2 is a view showing the portion indicated II in FIG. 1, on an enlarged scale.

As can best be seen in FIG. 2, on the side facing the rotor 16, the disc 12 has an annular projection 24 which partially penetrates a corresponding recessed annular portion 25 of the rotor 16, in an axial direction. A labyrinthine radial path is thus defined between the rotor 16 and the shaped disk 12. This path tends to prevent in operation lint, particles, etc., which are transported in operation by the pumped liquid, from accumulating in the vicinity of the drive shaft 20.

The sealing ring 11 has a radially outer portion which is clamped between the shaped disc 12 and the front wall or flange 5 of the body 3. This sealing ring has a radially intermediate portion 11*b* having a substantially annular shape and extending axially between the end portion 8*a* of the shaped wall 8 of the body 3 and the shaped disc 12.

The sealing ring 11 has a radially innermost portion 11*c* (see FIG. 2 in particular) which encircles the drive shaft 20 in a leaktight manner. In particular, this portion 11*c* of the sealing ring 11 forms two sealing lips 11*d* and 11*e* which are spaced apart axially and between which an annular channel 26 containing a lubricating grease is defined.

A resilient clamping member 27 is advantageously associated with the end of the portion 11*c* of the sealing ring 11 in which the lip 1*d* is fanned and tends to clamp the sealing lip against the drive shaft 20.

Between the radially innermost portion 11*c* and the intermediate portion 11*b*, the sealing ring 11 has a circular intermediate portion 11*f* which has a substantially U-shaped cross-section with its convex side facing the shaped disc 12, that is, towards the rotor 16. In particular, the convex side of the intermediate portion 11*f* of the sealing ring 11 extends in the immediate vicinity of (or even in contact with) the portion of the disc 12 which surrounds the drive shaft 20.

A second sealing ring, indicated 31, has an enlarged outer peripheral portion 31*a* which is engaged in the face groove 9 of the body 3. This sealing ring 31 forms, at its radially innermost end, a sealing lip 31*c* which encircles the shaft 20 in a leaktight manner in a position axially spaced tram the sealing ring 11, in particular, on the opposite side of the sealing ring 11 to the rotor 16.

An annular chamber 40, advantageously containing a lubricating grease, is defined between the sealing rings 11 and 31 and the shaft 20.

The particular shape of the circular portion 11*f* of the sealing ring 11 enables the volume of this lubrication chamber 40, and hence the operative life of the lubricating grease contained therein, to be maximized. Moreover, the volume of the annular space defined between this portion 11*f* of the sealing ring 11 and the disc 12 is advantageously minimized, with a corresponding reduction in the generation of vortices or turbulence. The rotation of the rotor is smoother and the operation of the pump is less noisy.

In operation, propagation of the pumped liquid along the shaft 20 is effectively prevented by the presence of the two lips 11*d* and 11*e* of the sealing ring 11, as well as by the grease held in the groove 26 between the lips, by the grease held in the lubricating chamber 40 and, finally, by the lip 31*c* of the sealing ring 31.

Naturally, the principle of the invention remaining the same, the forms of embodiment and the details of construction may be varied widely with respect to those described and illustrated purely by way of non-limiting example, without thereby departing from the scope of the invention as defined in the appended claims.

What is claimed is:

1. A pump for liquids, in particular, a centrifugal pump for electric household appliances and the like, comprising:

a rigid support structure including a body having an annular end in which an opening is defined, and a volute connected to the said end of the body so as to define a pumping chamber therewith, a bladed rotor disposed in the chamber and connected to a drive shaft which is mounted rotatably in the body and extends through the opening, and a first annular sealing member and a second annular sealing member which are carried by the structure and which encircle the drive shaft in a leaktight manner in respective axially spaced-apart positions, a lubrication chamber containing a lubricating grease being defined between the sealing members and the drive shaft, and a first sealing ring, closer to the rotor, having a radially inner portion which forms at least one sealing lip which bears on the shaft and a radially intermediate circular portion which is disposed outside the at least one lip and which has a substantially U-shaped cross-section with its convex side facing the rotor.

2. A pump for liquids according to claim 1 in which a shaped disc is disposed between the rotor and the first sealing ring and has a central opening through which the drive shaft extends with radial clearance, the disc having, on the side facing the rotor, at least one annular projection which at least partially axially penetrates a corresponding annular portion of the rotor in order to define a labyrinthine radial path therewith, the convex side of the intermediate circular portion of the first sealing ring extending in the immediate vicinity of the portion of the disc which surrounds the drive shaft.

3. A pump for liquids according to claim 2 in which the radially innermost portion of the first sealing ring forms two sealing lips which are spaced apart axially and between which a channel, also containing a lubricating grease, is defined.

4. A pump for liquids according to claim 3 in which that lip of the first sealing ring which faces the other sealing ring, has a resilient clamping member tending to clamp it against the drive shaft.

* * * * *